US007401429B1

(12) United States Patent
Kvortek

(10) Patent No.: US 7,401,429 B1
(45) Date of Patent: Jul. 22, 2008

(54) SHELVING SYSTEM CARRYING A POINT OF PURCHASE DISPLAY RACK WITH IMPROVED GRAPHIC PANELS

(75) Inventor: David V. Kvortek, New Kesington, PA (US)

(73) Assignee: Matthews Resources, Inc., Wilmington, DE (US)

( * ) Notice: Subject to any disclaimer, the term of this patent is extended or adjusted under 35 U.S.C. 154(b) by 408 days.

(21) Appl. No.: 11/312,125

(22) Filed: Dec. 20, 2005

(51) Int. Cl.
*G09F 7/00* (2006.01)
*G09F 15/00* (2006.01)

(52) U.S. Cl. ..... 40/606.01; 211/191; 40/600; 40/611.01

(58) Field of Classification Search ..... 40/606.01, 40/600, 611.01, 617, 618, 620, 621; 211/189, 211/286, 191, 134; 312/265.1, 265.5, 265.6
See application file for complete search history.

(56) References Cited

U.S. PATENT DOCUMENTS

| | | | | |
|---|---|---|---|---|
| 3,965,599 | A | 6/1976 | Ebner | |
| 3,987,567 | A | 10/1976 | Fritts | |
| 4,287,676 | A | 9/1981 | Weinhaus | |
| 4,657,147 | A * | 4/1987 | Le Mer | 211/58 |
| 5,058,359 | A * | 10/1991 | Lindblom | 52/732.1 |
| 5,421,112 | A | 6/1995 | Knorr | |
| 5,624,044 | A * | 4/1997 | Black, Jr. | 211/186 |
| 5,680,893 | A * | 10/1997 | Neer | 160/330 |
| 5,694,881 | A * | 12/1997 | Creech | 116/222 |
| 6,530,499 | B1 * | 3/2003 | Coleman et al. | 221/24 |
| 7,020,993 | B2 * | 4/2006 | Pritchard | 40/610 |
| 2004/0216390 | A1 * | 11/2004 | Healy et al. | 52/27 |
| 2006/0027344 | A1 * | 2/2006 | Lampe et al. | 160/209 |

* cited by examiner

*Primary Examiner*—Cassandra Davis
(74) *Attorney, Agent, or Firm*—R. S. Lombard

(57) ABSTRACT

In a point of purchase display having an integral graphic panel metallic supporting frame for an H-frame shelving system, retrofit pliant graphic panels are provided that may be quickly installed and remain firmly secured but may be quickly detached from the supporting frame to change the graphic message. The retrofit graphic panels utilize U-shaped top clips which are positioned to align with and operably engage the upper portions of the supporting frame and pliant magnetic strips attached to the back of the graphic panels to align with and magnetically adhere to lower portions of the metallic supporting frame. In another embodiment, in addition to the U-shaped top clips and pliant magnetic strips used to secure the graphic panels to the metallic supporting frame, leading edge clips are also utilized to secure certain of the graphic panels to product carrying bins of the point of purchase display.

20 Claims, 8 Drawing Sheets

SHELVING SYSTEM CARRYING A POINT OF PURCHASE DISPLAY RACK WITH IMPROVED GRAPHIC PANELS

BACKGROUND OF THE INVENTION

The present invention relates to a shelving system carrying a point of purchase display rack with an integral graphic panel metallic supporting frame and, in particular, to improved graphic panels for secure attachment to the display rack, but which can be easily removed as needed.

The prior art display rack includes graphic panels that are mounted to the graphic panel metallic supporting frame of the display rack by means of hardware, such as, metallic strips with apertures for alignment with apertures in the frame and apertures around the periphery of the graphic panels. The graphic panels are maintained in place through the use of threaded members passing through the aligned apertures of the frame, an associated graphic panel, and metallic strip and engaging corresponding wing nuts, for example, whereby the graphic panels are held firmly in position. The graphic panels are typically relatively stiff foam core panels which have a paper or other exterior material on both outer sides where a graphic message may be carried.

A point of purchase display rack such as this, often includes three "embedded" graphic panels forming a background for the point of purchase display rack. Typically, there is a central rear graphic panel and adjacent left and right side graphic panels, each positioned at an angle from the rear graphic panel. Typically, the rear panel is rectangular and the side panels are trapezoidal in shape. Of course, this depends on the display configuration. At the front of the rack an additional panel is often carried in a header portion of the frame. The rack is commonly positioned on the shelving system so that the graphic panels are readily observable to the consumer. As the consumer views the retail items contained in the point of purchase display rack, the graphic panels are situated such that the consumer will be immersed in the visual wrap-around effect of the graphic panels. The graphic panels very often carry a written message or a pictorial representation or both in some way dealing with the items carried by the rack. A rack such this may carry, for example, flooring items such as, elongated vinyl or wood moldings, flooring samples, flooring installation aids video, flooring cleaner and literature. The rack includes a number of bins for holding such flooring items.

Typically, the point of purchase display rack is maintained on a shelf of a shelving system, often referred to as an "H-frame" system such as widely seen at well known home improvement stores. Two or more horizontal shelves are often suspended between series of four vertical supports. The point of purchase display rack usually is carried on a lower shelf with shelving above which may carry other items. The three graphic panel arrangement as discussed above are typically positioned under a shelf directly above and are arranged to the rear and sides of the display rack which is attached to a lower shelf.

The display rack including the graphic panel supporting frame, is generally made of a ferromagnetic material such as steel or the like.

It has been found that with the prior art use of relatively stiff graphic panels and hardware including metallic strips, threaded members and nuts to hold the graphic panels in position, often requires a great deal of time to virtually completely empty a display rack filled with consumer goods to gain access to the graphic panels and the associated hardware when it is desired to change the graphic panels.

In addition it has been found that shipping the relatively stiff prior art graphic panels often may be quite expensive because the size of the panels. Another drawback of such a prior art use of such hardware to maintain the stiff graphic panels in place is its relative complexity.

SUMMARY OF THE INVENTION

The present invention is in combination with a common shelving system having a point of purchase merchandise display rack with integral graphic panel metallic supporting frame. Typically, such a shelving system includes modular "H-frame" portions. The modular "H-frame" portions each include pairs of front and rear horizontal shelf supports. The pairs of front and rear horizontal shelf supports are attached to and carried between pairs of vertical uprights. A shelf is carried by one of the pairs of front and rear horizontal supports. The point of purchase merchandise display rack is mounted on the shelf. The point of purchase display rack usually has more than one metallic merchandise carrying bin that is attached to the display rack. The integral graphic panel metallic supporting frame is also attached to the display rack. The integral graphic panel supporting frame usually includes a rear graphic panel supporting structure, a left graphic panel supporting structure and a right graphic panel supporting structure.

The improvement of the present invention in combination with the above-described shelving system includes retrofit pliant graphic panels carrying a graphic message on the front of the panels. The retrofit pliant graphic panels are preferably very supple, and may easily be bent, folded or rolled without breaking or cracking. The retrofit pliant graphic panels of the present invention have U-shaped top clips attached to the back of the graphic panels near the upper edge of the panels. The U-shaped top clips are positioned on the panel so that when the panel is in operable position the clips align with and are configured and sized to securely engage the upper portions of the supporting frame. Also attached to the back of the graphic panels in predetermine position are pliant magnetic strips or tape. The pliant magnetic strips are positioned to align with and operably adhere to the metallic supporting frame or the metallic carrying bins. The present invention provides retrofit pliant graphic panels that may be quickly installed and remain firmly secured to the supporting frame, but that may be quickly detached from the frame to change the graphic message as desired. The retrofit pliant graphic panels may be rolled up or folded for convenience in storage, shipping or installation.

The retrofit pliant graphic panels of the present invention preferably include rear, left and right panels each in operable engagement with the respective rear, left and right graphic supporting structure. The left graphic panel supporting structure and the right graphic panel supporting structure desirably includes portions of certain of the merchandise carrying bins.

Preferably, the back of the left graphic panel has left resilient U-shaped leading edge clips attached to it near the front edge thereof and operably engaging a leading edge of one of the certain merchandise carrying bins. Likewise, the back of the right graphic panel has right resilient U-shaped leading edge clips attached to it near the front edge thereof and operably engaging a leading edge of another of the certain merchandise carry bins.

The left graphic panel supporting structure and the right graphic supporting structure each typically, respectively includes a left side tubular support and a right side tubular support having a rectangular cross-section. The U-shaped top clips of the left side panel have an open side that desirably operably engage the left tubular support and, likewise, the U-shaped top clips of the right side panel have an open side that operably engage the right side tubular support. Preferably, the U-shaped top clips of the left and right side graphic panels are made of a resilient material, such as, plastic. Also, the U-shaped top clips of the left and right side graphic panels are sized to respectively firmly engage the left side and right side tubular supports.

The metallic carrying bins typically further have right and left side metallic side panels. The pliant magnetic strips are attached to the back of the right side graphic panel near the bottom thereof and operably engage the right side metallic side panel. In a similar fashion, the magnetic strips are also attached to the back of the left side graphic panel near the bottom thereof and operably engage the left side metallic side panel.

The rear graphic supporting structure usually has a rectangular metallic rear graphic panel frame. The rectangular rear graphic panel has a top member, a bottom member, left side and right side members. The rear graphic panel desirably has the U-shaped top clips having an open bottom attached to the back of the rear graphic panel near the upper edge thereof and operably engages the top member of the rear graphic panel frame. The rear graphic panel has pliant magnetic strips attached to the back thereof near the bottom and sides of the panel such that the strips operably engage the left side member, right side member and bottom member of the rear graphic panel frame. Other features of the invention are hereinafter discussed in detail.

BRIEF DESCRIPTION OF THE DRAWINGS

For a better understanding of the invention, reference may be had to the accompanying drawings exemplary of the invention, in which.

BRIEF DESCRIPTION OF THE PREFERRED EMBODIMENTS

Figure 1:
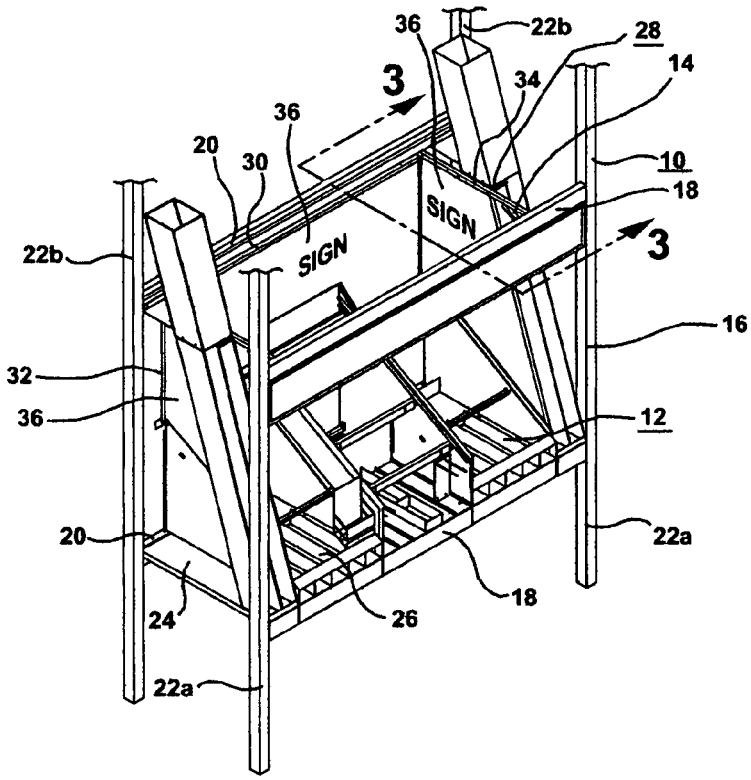
Fig. 1 (Prior Art)
FIG. 1 is a perspective view of a prior art shelving system carrying a point of purchase display with metal strips overlaying the edges of the graphic panels with fasteners (not shown) passing though the strips and panels engaging the graphic panel supporting frame.
Figure 3:
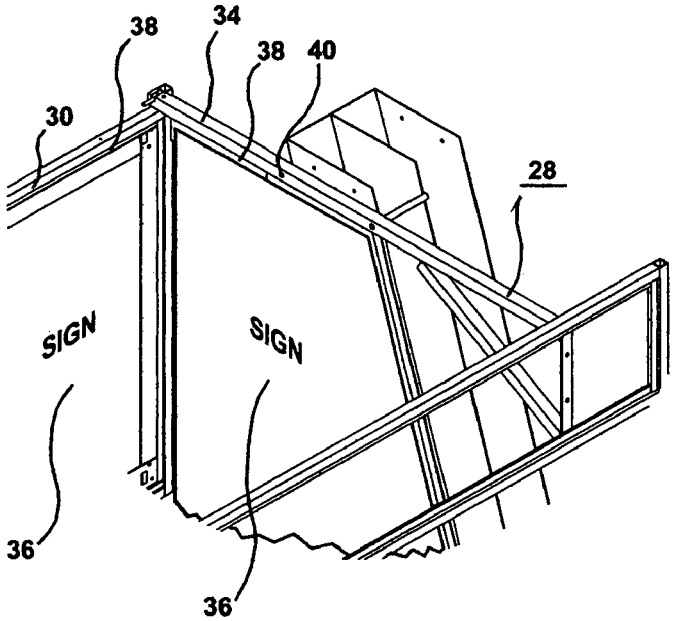
Fig. 3 (Prior Art)
FIG. 3 is a sectional perspective view taken along the line 3-3 of FIG. 1.

Referring to FIG. 1, there is shown a shelving system 10 including a point of purchase display rack 12 having an integral graphic panel metallic supporting frame 14. The shelving system 10 includes modular H-frame portions 16 each typically including multiple pairs of a front horizontal shelf support 18 and a rear horizontal shelf support 20. The front and rear shelf supports are attached to and carried by pairs of vertical uprights 22*a*, 22*b*. A shelf 24 is carried by a pair of front and rear shelf supports 18, 20. The point of purchase display rack 12 is mounted on the shelf 24. The point of purchase display rack 12 typically has many metallic merchandise carrying bins 26. The bins 26 may carry, for example, flooring items, such as, elongated vinyl or wood moldings, flooring samples, flooring installation aids videos, flooring cleaner and literature. The point of purchase display 12 also typically has attached an integral graphic metallic supporting frame 28. The supporting frame 28 commonly has a rear graphic panel supporting structure 30, a left graphic panel supporting structure 32 and a right graphic panel supporting structure 34. As shown in FIG. 3, the graphic panels 36 of the prior art as mentioned previously, were usually mounted to the supporting frame 28 by means of hardware, such as, metallic strips 38 with apertures 40 aligned with apertures in the supporting frame 28, not shown, and apertures, not shown, around the periphery of the graphic panels. The graphic panels 36 of the prior art, as previously mentioned, were typically made of a relatively stiff and thick foam core having an exterior layer on both sides of paper or some other material. As mentioned, the graphic panels 36 were often maintained in place through the use of threaded members, not shown, passing through the aligned apertures of the frame, an associated graphic panel 36, and metallic strip 38 and engaging corresponding wing nuts, not shown. The removal of the prior graphic panels could be quite time consuming because of the open access needed to dismantle the associated hardware including metallic strip 38 and wing nuts often requiring removal of all the display items to gain sufficient access to remove the stiff prior art graphic panels.

Figure 2:
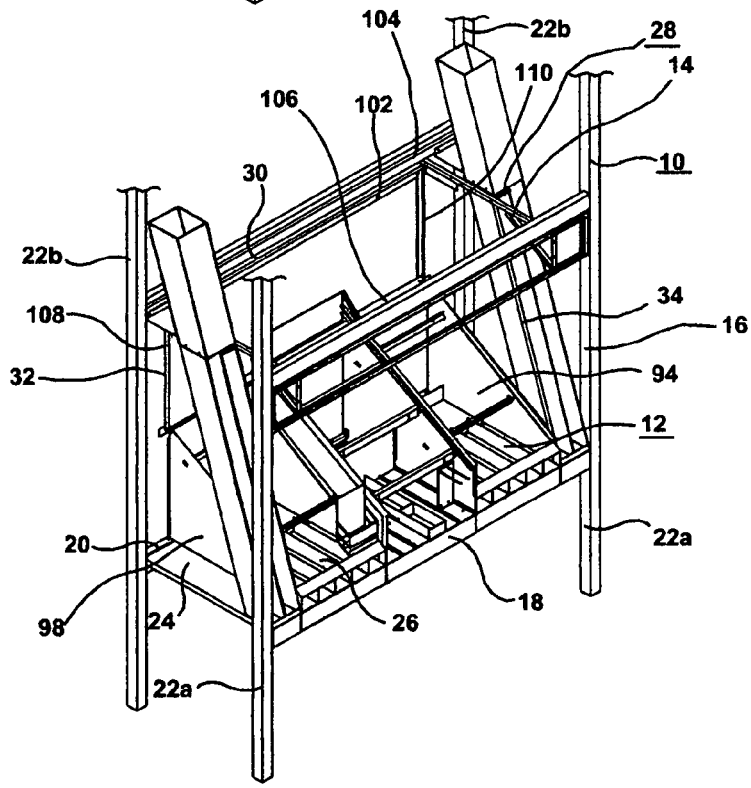
FIG. 2 is a perspective view of the shelving system shown if FIG. 1 without the graphic panels.
Figure 4:
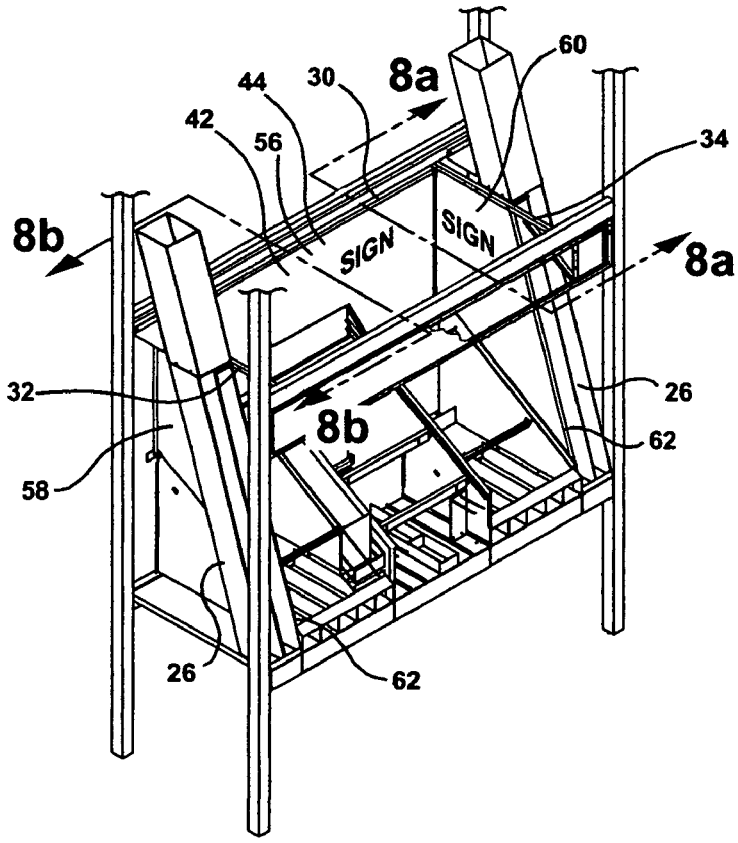
FIG. 4 is a perspective view of the present invention shelving system carrying a point of purchase display with improved graphic panels.
Figure 5:
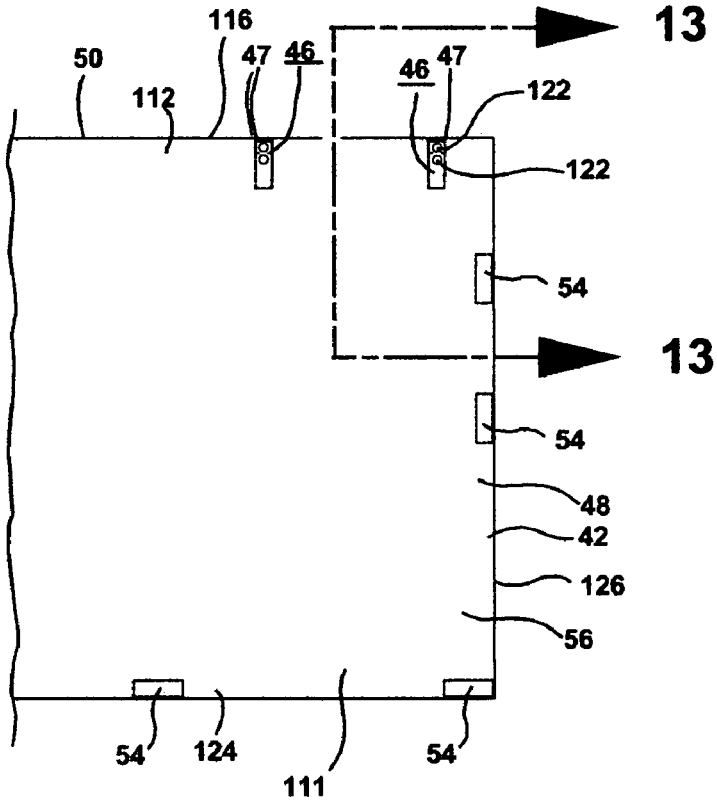
FIG. 5 is a partial rear view of the improved rear graphic panel shown in FIG. 4.
Figure 6:
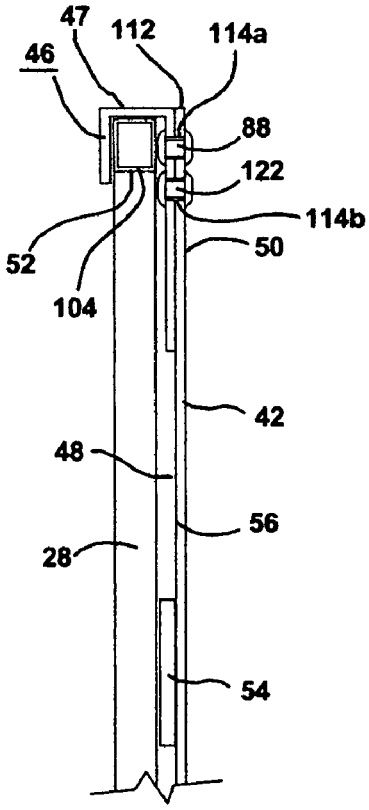
FIG. 6 is a partial right side elevation view of the improved rear graphic panel shown in FIG. 5.
Figure 8A:
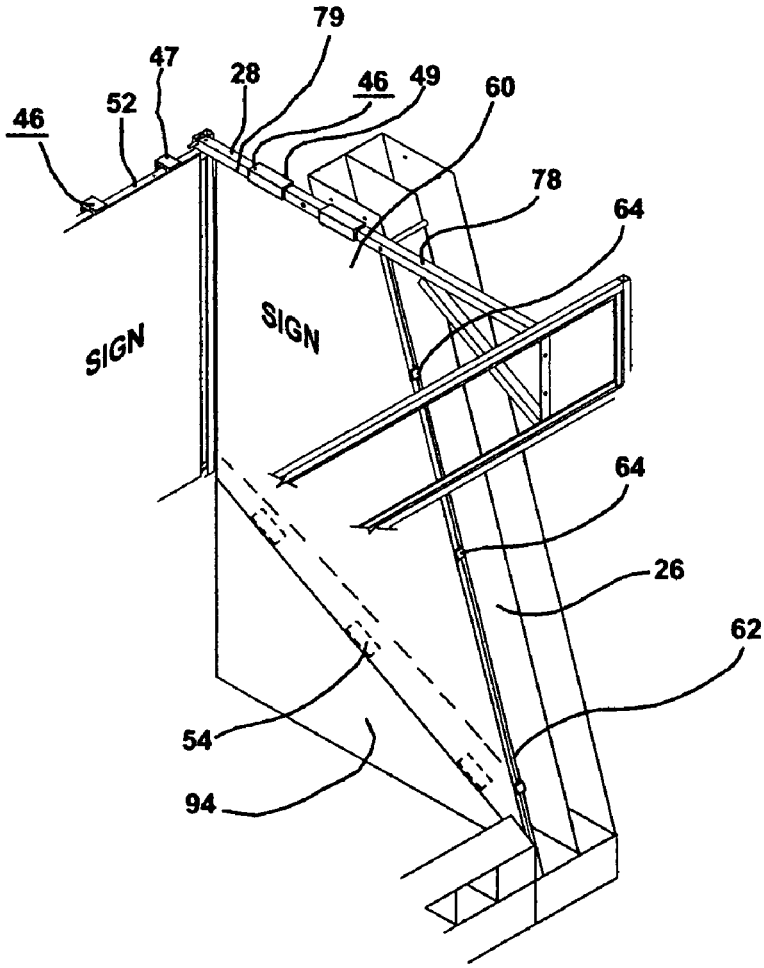
FIG. 8*a* is a sectional perspective view taken along the line 8*a*-8*a* of FIG. 4.

The shelving system 10 as described thus far is conventional, FIG. 2 shows the shelving system 10 without graphic panels 36 and associated panel maintaining hardware, including metallic strips 38. The improvement of the present invention includes retrofit pliant graphic panels 42, carrying a graphic message on the front 44 thereof as shown in FIG. 4. The pliant graphic panels 42 may be made of a thin plastic sheet, such as, styrene, which may be 0.060 inches thick, for example. With reference to FIGS. 5 and 6, for example, U-shaped top clips 46 are attached to the back 48 of the graphic panel 42 near the upper edge 50. The U-shaped top clips 46 are aligned with and operably engage the upper portions 52 of the graphic supporting frame 28, as shown in FIG. 8*a*. As shown in FIG. 6, clips 46 overhang supporting frame 28. Pliant magnetic strips 54 are preferably adhesive backed and are attached to the back 48 of the graphic panels 36, as shown in FIGS. 5 and 6. The pliant magnetic strips 54 are positioned to align with and operably adhere by means of magnetism to the metallic supporting frame 28 or the metallic carrying bins 26. The present invention permits the graphic panels 42 to be quickly installed and remain firmly secured, but may be quickly detached from the supporting frame 28 as desired to change the graphic message.

In a preferred configuration referring to FIG. 4, the retrofit pliant graphic panels 42 include a rear graphic panel 56 in operable engagement with the rear graphic panel supporting structure 30. A left retrofit graphic panel 58 in operable engagement with the left graphic panel supporting structure 32. A right retrofit graphic panel 60 in operable engagement with the right graphic panel supporting structure 34. The left graphic panel supporting structure 32 may include portions 62 of certain of the merchandise carrying bins 26 as shown in FIGS. 4, 8*a*, 8*b* and 9, for example.

With reference to FIGS. 8*a*, 8*b* through 13, the right retrofit graphic panel 58 is preferably provided with resilient U-shaped leading edge clips 64 attached to the back 66 of the right graphic panel 60 proximate the front edge 68 thereof and operably engaging a leading edge 69 of one of the merchandise carrying bins 70. Likewise, the left retrofit graphic panel 58 is preferably providing with resilient U-shaped leading edge clips 64 attached to the back 72 of the left graphic panel 58 proximate the front edge 68 thereof and operably engaging the leading edge 71 of another one of the merchandise carrying bins 74. The leading edge clips 64 may be made of a plastic such as styrene, which may be 0.125 inches thick, for example. The plastic is heated and bent to the desired shape to form the clips 64. The leading edge clips 64 may be attached to the back 66 of the right panel 60 and the back 72 of the left panel 58 by a solvent which bonds the plastic of the plastic graphic panels 58 and 60 which are also preferably a plastic such as styrene.

Figure 8B:
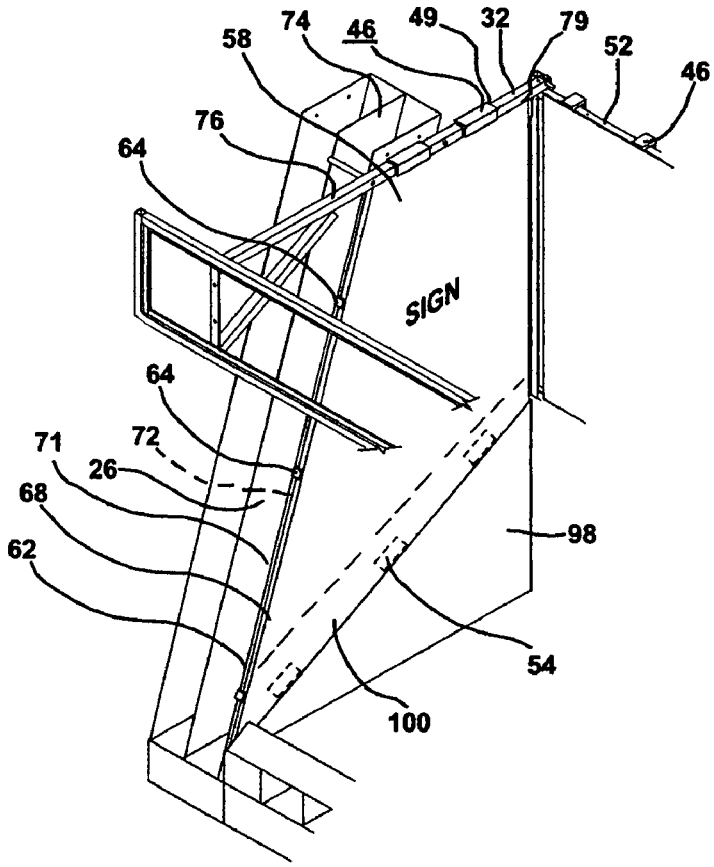
FIG. 8*b* is a sectional perspective view taken along the line 8*b*-8*b* of FIG. 4.
Figure 9:
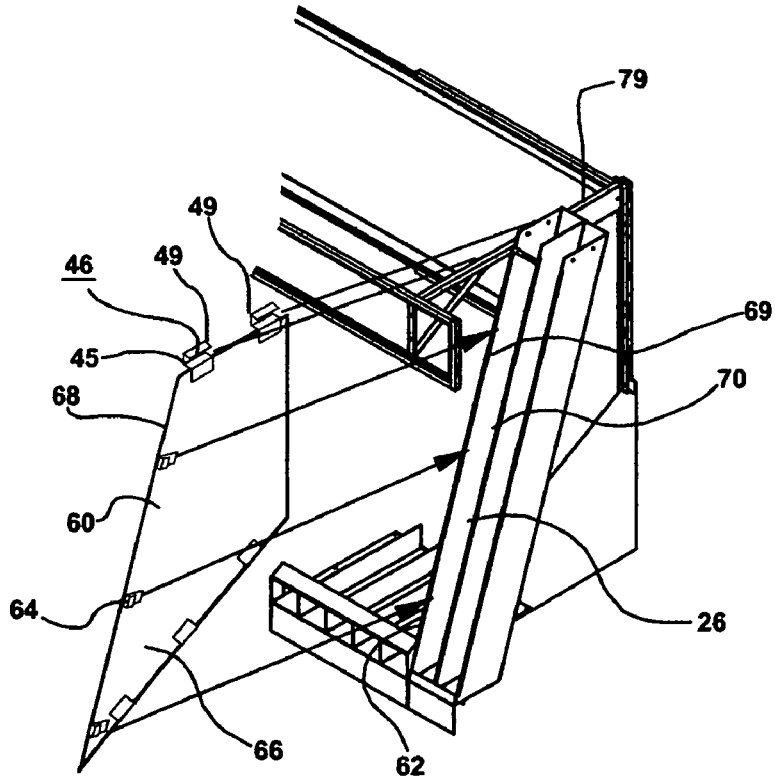
FIG. 9 is a partially exploded sectional perspective view taken along the line 8*a*-8*a* of FIG. 4.

The left graphic panel supporting structure 32 typically has a left side top horizontal tubular support member 76, as shown in FIG. 8*b*. The right graphic panel supporting structure 34 typically has a right side top horizontal tubular support member 78, as shown in FIG. 8*a* and FIG. 9. The left side top tubular support member 76 and the right side top tubular support member 78 commonly have a rectangular cross-section. The U-shaped top clips 46 attached to the left graphic panel 58 operably engage the left side top tubular support member 76, as shown in FIG. 8*b*. The U-shaped top clips 46 attached to the right graphic panel 60 operably engage the right side top tubular support member 78, as shown in FIG. 8*a* and FIG. 9. Preferably, the U-shaped top clips 46 of the left graphic panel 58 and the U-shaped top clips 46 of the right graphic panel 60 are comprised of a resilient material, such as plastic, and these top clips 46 are an open side version 49. The open side U-shaped top clips 49 in operable position during installation on said left support member 76 and said right support member 78 have the trough 45 of U-shaped clip 49 face the interior sides 79 of said support members 76,78. Preferably, the open side U-shaped top clips 49 of the left graphic panel 58 and the open side U-shaped top clips 49 of the right graphic panel 60 are comprised of a resilient material, such as plastic and sized to firmly respectively engage the left side top horizontal tubular support member 76 and the right side top horizontal tubular support member 78. The clips 49 may be made of styrene and formed as previously described for the leading edge clips 64.

Figure 10:
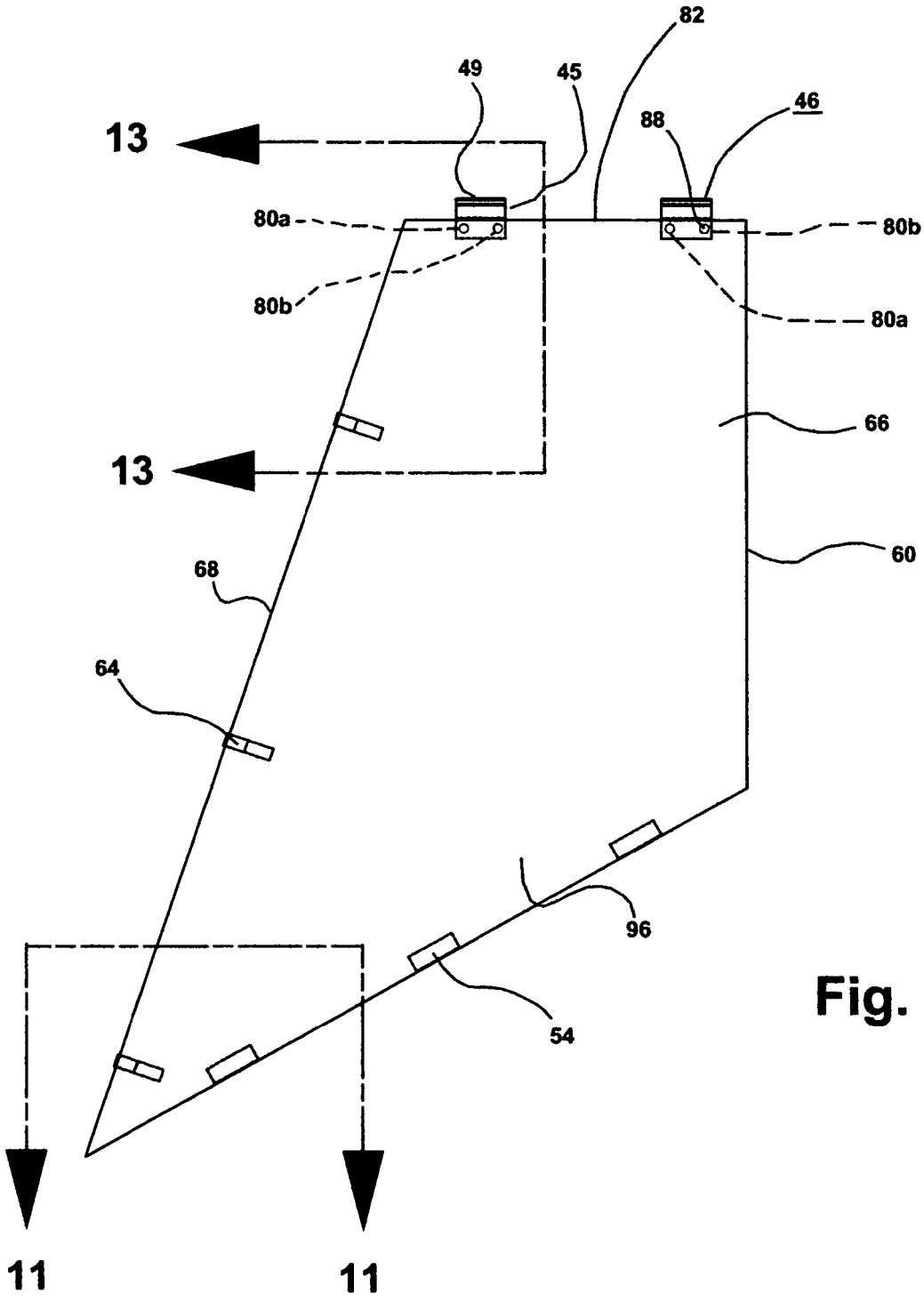
FIG. 10 is an elevation view of the back of the left side graphic panel of the present invention.
Figure 11:
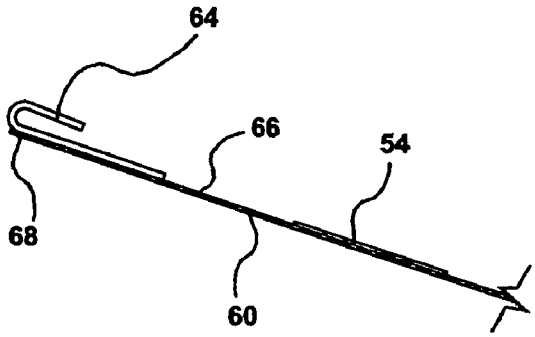
FIG. 11 is sectional view of a portion of the left side graphic panel taken along the line 11-11 of FIG. 10.
Figure 12:
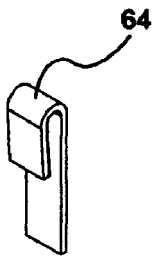
FIG. 12 is a perspective view of the left U-shaped leading edge clip of the left side graphic panel shown in FIG. 11
Figure 13:
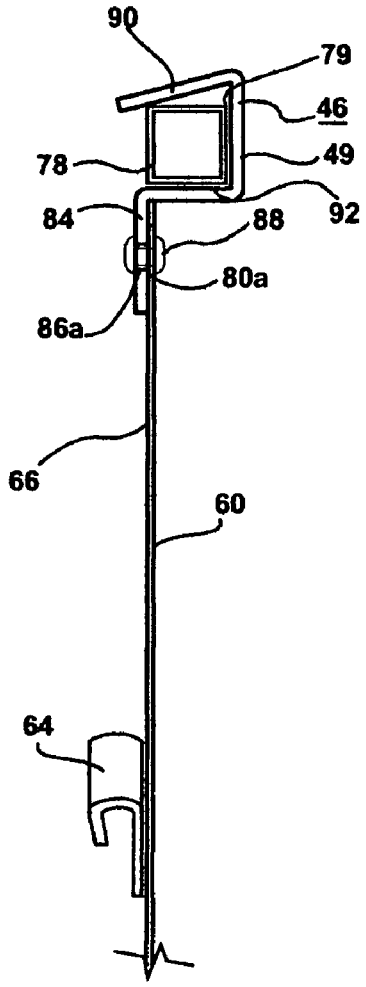
FIG. 13 is a sectional view of a portion of the left side graphic panel taken along the line 13-13 of FIG. 10; and, FIG. 14 is a perspective view of the U-shaped top clip of the left side graphic panel as shown in FIGS. 10 and 13.
Figure 14:
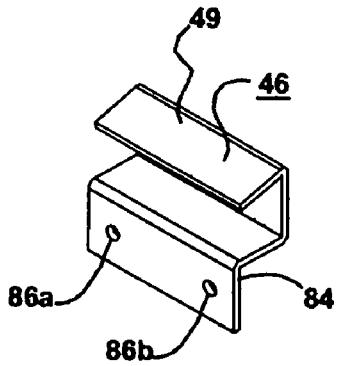

With reference to FIGS. 10, 13 and 14, the right graphic panel 60 has a plurality of pairs of first apertures 80*a*, 80*b* near the upper edges 82 thereof, and, likewise, the left graphic panel has the same arrangement not shown. The plastic open side top U-shaped clips 49, as shown in FIGS. 13 and 14, have perpendicular extension portions 84 having second apertures 86*a*, 86*b* passing therethrough. Each of the open side plastic top U-shaped clips 49 are arranged with the second apertures 86*a*, 86*b* in operative alignment with a pair of the first apertures 80*a*, 80*b* of the left graphic panel 58 and the right graphic panel 60. First metallic post fasteners 88 pass through the first apertures 80*a*, 80*b* of the left graphic panel 58 and the right graphic panel 60 and the second apertures 86*a*, 86*b* of the plastic top U-shaped clips 46 operatively attaching the clips 49 to the left graphic panel 58 and the right graphic panel 60. The plastic top U-shaped clips 46 may be comprised of styrene, for example. The first metallic post fasteners 88 may be aluminum post fasteners which may be screw posts such as sold by Charles Leonard National, Inc. of P.O. Box 18048, Hauppauge, N.Y. 11788. As can be seen in FIG. 13, the open side plastic top U-shaped clip 49, desirably, has an upper portion 90 that is offset at an angle inwardly toward opposite lower portion 92. This configuration of the clip 49 when properly sized to engage either the left side top horizontal tubular support member 76 or the right side top horizontal tubular support member 78, causes the portion 90 of the clip 49 to be expanded outwardly away from the lower portion 92 as the panels 58, 60 are installed to firmly grasp either left side member 76 or right side member 78.

Typically, the metallic carrying bins 26 include a right side metallic panel 94 as shown in FIG. 2. The pliant magnetic strips 54 are attached to the back 66 of the right graphic panel 60 near the bottom 96 thereof, as shown in FIG. 10. When the right graphic panel is installed in the frame 14, the strips 54 are magnetically attracted to the right side metallic panel 94 to hold the bottom 96 of the graphic panel 60 firmly in place. Likewise, the metallic carrying bins 26 also include a left side metallic panel 98 as shown in FIG. 2. The pliant magnetic strips 54 are attached to the back 72, as shown if FIG. 8*b*, of the left graphic panel 58 near the bottom 100 thereof. When the left graphic panel 58 is installed in the frame 14, the strips 54 are magnetically attracted to the left side metallic panel 98 to hold the bottom 100 of the graphic panel 58 firmly in place. The pliant magnetic strips 54 may be adhesive backed magnetic tape, having dimensions one inch in width by 3 inches in length and having a thickness of 0.060 inches, such as sold by Magnetic Specialty Inc. of 707 Gilman Street, Marietta, Ohio 45750.

Figure 7:
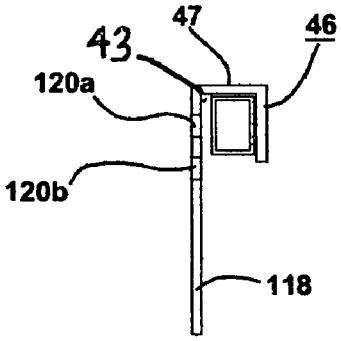
FIG. 7 is a side elevation view of a U-shaped top clip of the rear graphic panel shown in FIGS. 5 and 6.

The rear graphic panel supporting structure 30 typically has a rectangular metallic graphic panel frame 102, as shown in FIG. 2. The rear graphic panel frame 102 usually has top member 104, a bottom member 106, a left side member 108 and a right side member 110. The U-shaped top clips 46 are attached to the back 111 of the rear graphic panel 56 near the upper edge 112 of the rear graphic panel 56 and operably engage the top member 104. Preferably the U-shaped top clip 46 attached to the back 111 of the rear graphic panel 56 are made of metal, for example, steel, and these top clips 46 are an open bottom version 47. With reference to FIGS. 6 and 7, in operable position the open bottom clips 47 hang over top member 104, with the trough 43 of the open bottom U-shaped top clip 47 facing downwardly in the operable position.

With reference to FIGS. 5-7, rear graphic panel 56 has a plurality of pairs of third apertures 114*a*, 114*b* near the upper edge 116 thereof. The metal open bottom top U-shaped clips 47 each have a flat extension portion 118 having fourth apertures 120*a*, 120*b* passing therethrough. Each of the open bottom metal top U-shaped clips 47 when in operative position have the fourth apertures 120*a*, 120*b* in alignment with the pair of the third apertures 114*a*, 114*b* of the rear graphic panel 56. Second metallic post fasteners 122 pass through the third apertures 114*a*, 114*b* of the rear panel 56 and the fourth apertures 120*a*, 120*b* of the open bottom metal top U-shaped clips 47 to operatively attach the clips 47 to the rear panel 56, as shown in FIG. 6.

Preferably, the pliant magnetic strips 54, having the adhesive backing as described above, are attached to the bottom 124 and the sides 126 of the rear graphic panel, as shown in FIG. 5. The attached magnetic strips 54 operably engage the left side member 108, right side member 110 and bottom member 106 of the rectangular metallic rear graphic panel frame 102 by magnetic attraction. Preferably, the frame is ferromagnetic.

The present invention utilizes the firm grasping of the two versions of the top U-shaped clips 46, i.e., open bottom clip 47 and open side clip 49, and the leading edge clips 64 together with the magnetic strips 54 to prevent any movement of the graphic panels 56, 58 and 60 due to lateral forces when mounted in position on the supporting frame. Yet the invention allows for quick installation and removal of the panels 56, 58 and 60 without the necessity of removal of all the display items from the display rack 12. The rear graphic panel 56 having the open bottom clips 47 allows the panel 56 to be lowered in a vertical orientation over the top member 104. The magnetic strips 54 magnetically secure the remaining periphery of graphic panel 56 to the metallic bottom member 106, left side member 108 and right side member 110. It has been found that the leading edge clips 64 of the left graphic panel 58 and the right graphic panel 60 are desirably first slipped over the respective leading edges 69, 71 of the merchandise bins 70, 74. Once the leading edge clips 64 are properly positioned, the magnetic strips 54 may be positioned and the open side top clips 47 may be pressed in a sideward manner to engage the left side of the top support member 76 and the right side of the top support member 78. During the removal and installation of the pliant graphic panels 56, 58 and 60, they may be rolled-up or folded as desired to maneuver around most display items, greatly reducing the necessity of having to remove virtually all of the display items as was often necessitated with the prior art configuration. It has been found by using the present invention it enables one person to change out the graphic panels 56, 58 and 60, as opposed to a two person operation with the prior art scheme as previously described. The present invention reduces the time required for the changing of graphic panels from approximately two hours with two people to less than one half hour with one person.

What is claimed is:

1. In combination with a shelving system having a point of purchase merchandise display rack with integral graphic panel metallic supporting frame, Said shelving system having modular H-frame portions each including a plurality of pairs of a front horizontal shelf support and a rear horizontal shelf support, said front and rear shelf supports affixed to and carried between pairs of vertical uprights, a shelf carded by one of said pairs of said front and rear shelf supports, said point of purchase merchandise display rack mounted on said shelf, said point of purchase display rack including a plurality of metallic merchandise carrying bins and having affixed thereto in predetermined position said integral graphic panel metallic supporting frame, said supporting frame including a rear graphic panel supporting structure, a left graphic panel supporting structure and a fight graphic panel supporting structure, wherein the improvement comprises:

retrofit pliant graphic panels carrying a graphic message on the front thereof, U-shaped top clips affixed to the back of said graphic panels in predetermined position proximate an upper edge thereof, said U-shaped top clips positioned to align with and operably engage the upper portions of said supporting frame, pliant magnetic strips affixed to the back of said graphic panels in predetermined position to align with and operably adhere to said metallic supporting frame or said metallic carrying bins, whereby said retrofit graphic panels may be quickly installed and remain firmly secured but may be quickly detached from said supporting frame to change said graphic message as desired.

2. The combination of claim 1, wherein said retrofit pliant graphic panels include a rear retrofit graphic panel in operable engagement with said rear graphic panel supporting structure, a left retrofit graphic panel in operable engagement with said left graphic panel supporting structure, a right retrofit graphic panel in operable engagement with said right graphic panel supporting structure.

3. The combination of claim 2, wherein said rear graphic supporting structure includes a rectangular metallic graphic panel frame, said rectangular metallic graphic panel frame having a top member, a bottom member, a left side member and a right side member, said U-shaped top clips having an open bottom and affixed to the back of said rear retrofit graphic panel proximate the upper edge thereof and operably receiving and engaging the top member of said rectangular metallic graphic panel frame, whereby said U-shaped top clips are placed in firm engagement with said top member by first aligning said open bottom of said U-shaped top clips with the top of said top member and pressing downwardly said open bottom U-shaped top clips into position.

4. The combination of claim 3, wherein said magnetic strips of said rear retrofit graphic panel are affixed to the back thereof proximate the bottom and the sides thereof and operably engaging the left side member, right side member and bottom member of said rectangular metallic rear graphic panel frame.

5. The combination of claim 2, wherein said rear retrofit graphic panel has a plurality of pairs of third apertures therethrough proximate the upper edge thereof, said U-shaped top clips each having a flat extension portion having fourth apertures therethrough, said fourth apertures of said flat extension portion of said U-shaped top clips in operative alignment with a pair of said third apertures of said rear retrofit graphic panel, second metallic post fasteners passing though said third apertures of said rear retrofit graphic panel and said fourth apertures of said U-shaped top clips operatively attaching said U-shaped top clips to said rear retrofit graphic panel.

6. The combination of claim 2, wherein said left graphic panel supporting structure and said right graphic panel supporting structure includes portions of at least one said merchandise carrying bins.

7. The combination of claim 6, further comprising resilient U-shaped leading edge clips affixed to the back of said right retrofit graphic panel proximate the front edge thereof and operably engaging a leading edge of one of said merchandise carrying bins.

8. The combination of claim 7, further comprising resilient U-shaped leading edge clips affixed to the back of said left retrofit graphic panel proximate the front edge thereof and operably engaging a leading edge of another of said certain merchandise carrying bins.

9. The combination of claim 8, wherein said left graphic panel supporting structure includes a left side top horizontal tubular support member and said right graphic panel supporting structure includes a right side top horizontal tubular support member, said U-shaped top clips of said left retrofit graphic panel having an open side and operably engaging said left side top tubular support member and said U-shaped top clips of said right retrofit graphic panel having an open side and operably engaging said right side top tubular support member.

10. The combination of claim 9, wherein said metallic carrying bins further includes a right side metallic side panel, said magnetic strips affixed to the back of said right retrofit graphic panel proximate the bottom thereof and operably engaging said right side metallic side panel.

11. The combination of claim 10, wherein said U-shaped top clips of said rear graphic panel are comprised of metal.

12. The combination of claim 11, wherein said U-shaped top clips of said graphic panel are comprised of steel.

13. The combination of claim 10, wherein said metallic carrying bins further include a left side metallic side panel, said magnetic strips affixed to the back of said left retrofit graphic panel proximate the bottom thereof and operably engaging said left side metallic side panel.

14. The combination of claim 9, wherein said U-shaped top clips of said left retrofit graphic panel and said right retrofit graphic panel are comprised of a resilient material.

15. The combination of claim 14, wherein said U-shaped top clips of said left retrofit graphic panel and said right retrofit graphic panel are comprised of a plastic.

16. The combination of claim 15, wherein said open side of said U-shaped top clips of said left retrofit graphic panel and said right retrofit graphic panel are sized to respectively receive and firmly engage said left side top horizontal tubular support and said right side top horizontal tubular support, whereby said open side of said U-shaped top clips snap into firm engagement with said left side top horizontal tubular support and said right side top horizontal tubular support by first aligning said open side of said U-shaped top clips with an inwardly facing side of said left side top horizontal tubular support and said right side top horizontal tubular support.

17. The combination of claim 16, wherein said left retrofit graphic panel and said right retrofit graphic panel have a plurality of pairs of first apertures therethrough proximate upper edges thereof, said open side of said U-shaped top clips having perpendicular extension portions having second apertures therethrough, each of said open side of said U-shaped clips having said second apertures in operative alignment with a pair of said first apertures of said left retrofit graphic panel and said right retrofit graphic panel, first metallic post fasteners passing through said first apertures of said left retrofit graphic panel and said right retrofit graphic panel and said second apertures of said open side of said U-shaped clips operatively attaching said U-shaped clips to said left retrofit graphic panel and said right retrofit graphic panel.

18. The combination of claim 1, wherein said graphic panel metallic supporting frame is ferromagnetic.

19. The combination of claim 1, wherein said retrofit pliable graphic panels are comprised of a plastic of predetermined thickness, whereby said panels may be easily bent, folded or rolled.

20. The combination of claim 19, wherein said retrofit pliable graphic panels are comprised of styrene.

* * * * *